US005832337A

United States Patent [19]

Isemura

[11] Patent Number: 5,832,337

[45] Date of Patent: Nov. 3, 1998

[54] IMAGE FORMING APPARATUS HAVING A ONE SIDE MODE FOR FORMING AN IMAGE ON ONE SIDE OF A RECORDING SHEET AND A BOTH SIDE MODE FOR FORMING AN IMAGE ON BOTH SIDES OF A RECORDING SHEET

[75] Inventor: Keizo Isemura, Koganei, Japan

[73] Assignee: Canon Kabushiki Kaisha, Tokyo, Japan

[21] Appl. No.: 791,419

[22] Filed: Jan. 30, 1997

[30] Foreign Application Priority Data

Feb. 5, 1996 [JP] Japan ..... 8-018762

[51] Int. Cl.[6] ..... G03G 15/00

[52] U.S. Cl. ..... 399/81; 399/85

[58] Field of Search ..... 399/81, 82, 83, 399/85, 11

[56] References Cited

U.S. PATENT DOCUMENTS 5,491,557 2/1996 Nakajima et al. ..... 358/296

FOREIGN PATENT DOCUMENTS 57-148759 9/1982 Japan .
62-200365 9/1987 Japan .

*Primary Examiner*—Joan H. Pendegrass
*Attorney, Agent, or Firm*—Fitzpatrick, Cella, Harper & Scinto

[57] ABSTRACT

As a service man resisters in a maintenance mode a both side copy mode as a standard copy mode, a one side copy key and a "one side→both sides" key are displayed on an operation/display unit. If an optional mode to be registered as the standard copy mode by a user does not contain the both side copy mode, a change in the standard copy mode is inhibited.

23 Claims, 14 Drawing Sheets

IMAGE FORMING APPARATUS HAVING A ONE SIDE MODE FOR FORMING AN IMAGE ON ONE SIDE OF A RECORDING SHEET AND A BOTH SIDE MODE FOR FORMING AN IMAGE ON BOTH SIDES OF A RECORDING SHEET

BACKGROUND OF THE INVENTION

1. Field of the Invention

The present invention relates to an image forming apparatus capable of forming images on both sides of a recording sheet.

2. Related Background Art

A conventional image forming copier generally has a one side copy mode as a default of a standard copy mode, and an operation display setting means has been designed by using a one side copy mode as a standard. Therefore, it is easy to set a one side copy mode.

This standard copy mode is now changing to a both side copy mode because chances of both side copies are increasing because there is a tendency of economizing natural paper resources. A user accustomed to the one side copy may erroneously copy images on both sides if the user does not know the copier has the both side mode as the standard copy mode.

The one side copy mode is not set by pressing a reset key, but in order to set it, it is necessary to first release the both side copy mode. In releasing the both side copy mode, operations of several steps are required so that the copier becomes not easy to use.

If the both side copy mode is released from the standard copy mode, the effects of saving natural paper resources are halved.

SUMMARY OF THE INVENTION

An image forming apparatus has a one side mode for forming an image on one side of a recording sheet, and a both side mode for forming an image on both sides of a recording sheet. The apparatus includes a standard mode registering device for registering the both side mode as one of standard modes of the apparatus, and a plurality of soft keys are included on a display device, whose functions change in response to an operation by an operator. Also included is a setting device which sets one of the soft keys as a one side mode key used for selecting the one side mode, if the both side mode is registered as one of the standard modes.

It is an object of the present invention to provide an image forming apparatus capable of eliminating the above problems.

It is another object of the present invention to provide an image forming apparatus capable of readily selecting a one side mode even if a both side mode is registered as a standard copy mode.

It is another object of the present invention to provide an image forming apparatus capable of saving natural resources by forcibly registering a both side copy mode when a standard copy mode is registered.

Other objects of the present invention will become apparent from the following description and appended claims when read in conjunction with the following accompanying drawings.

DETAILED DESCRIPTION OF THE PREFERRED EMBODIMENTS

An embodiment of the present invention will be described with reference to the accompanying drawings.

Figure 1:
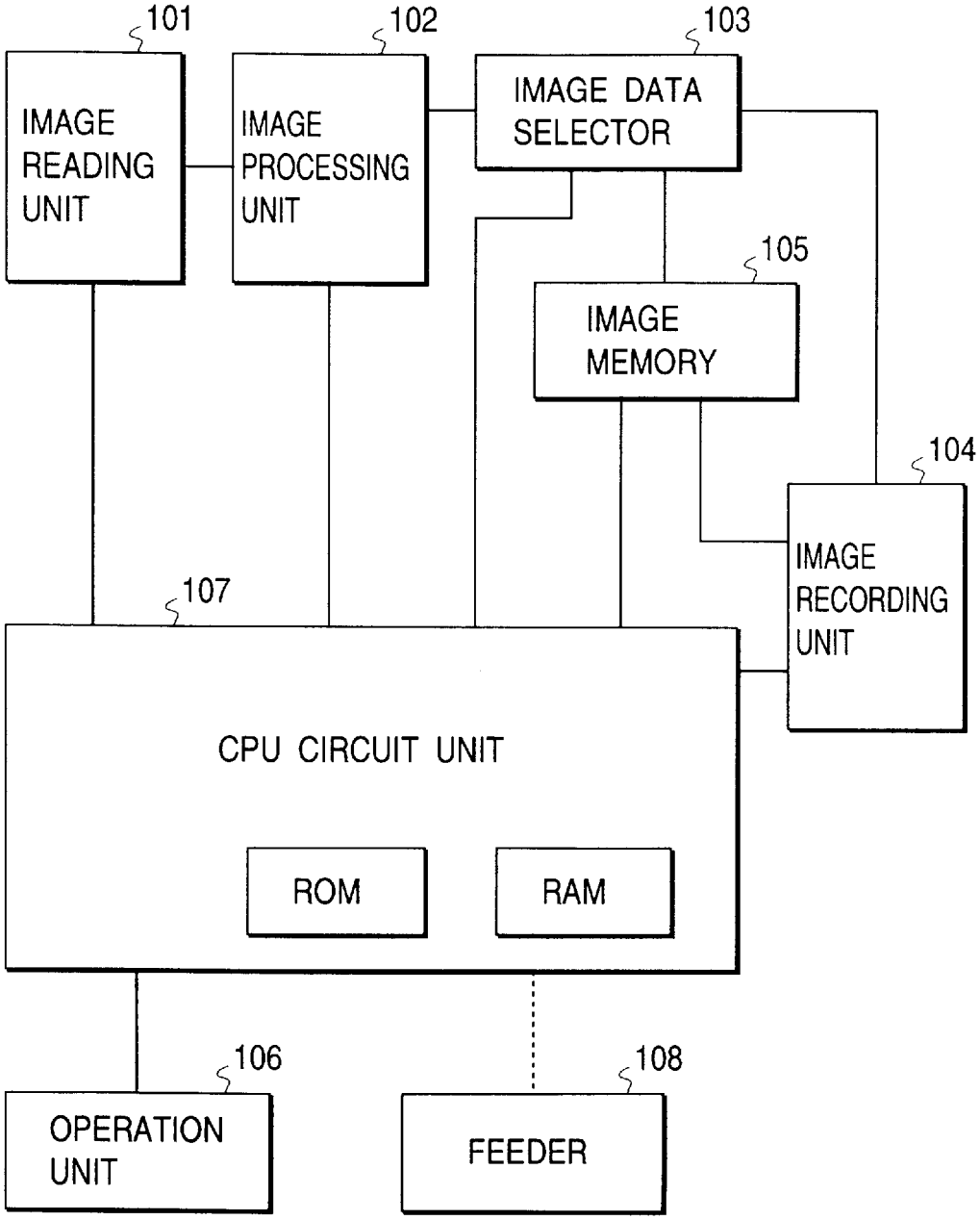
FIG. 1 is a block diagram showing the structure of an image forming apparatus.

FIG. 1 is a block diagram showing the overall structure of a control circuit of an image forming apparatus to which the invention is applicable.

An image reading unit 101 is constituted of a CCD, an A/D converter, and the like. The CCD receives light reflected from an original image and passed through an optical system, and converts it into an analog signal. The A/D converter converts the analog signal received from the CCD into a digital signal. The image reading unit 101 transfers a read image signal to an image processing unit 102.

The image processing unit 102 is constituted of a shading correction circuit, a color density conversion circuit, an image editing circuit for editing an image, such as variable magnification, movement, decoration, and the like, in accordance with a user instruction, and other circuits. An image input from the image reading unit 101 is corrected and edited. The edited image is then sent via an image data selector 103 to an image recording unit 104 or an image memory 105.

The image data selector 103 is constituted of a data bus switching circuit, an image data switching/synthesizing circuit, and other circuits. The data bus switching circuit switches between a path for sending data supplied from the image processing unit 102 to the image recording unit 104 and a path for sending data supplied from the image processing unit 102 to the image memory 105, in response to an instruction from a CPU circuit unit 107 to be later described. The image data switching/synthesizing circuit switches between the image data supplied from the image processing unit 102 and the image data read from the image memory 105 or synthesizes these image data.

The image recording unit 104 copies an image to a recording sheet in accordance with the density signal of image data sent from the image data selector 103.

The CPU circuit unit 107 controls the entire system of this apparatus. The CPU circuit unit 107 is constituted of a ROM for storing a control program, an error processing program, a layout determining program, and the like, a RAM used for a working area for various programs, various timer control units, and other circuits.

An operation unit 106 has various key groups, a display unit, and the like. The various key groups are used for instructing the image processing unit 102 to perform image copy operations and the like, such as designating the image editing contents, copy number, variable magnification ratio, and the like. The display unit displays the operation contents.

A feeder 108 feeds an original placed on a loader of the feeder to an original support, and detects the number and size of placed originals to send associated signals to the CPU circuit unit 107.

Figure 2:
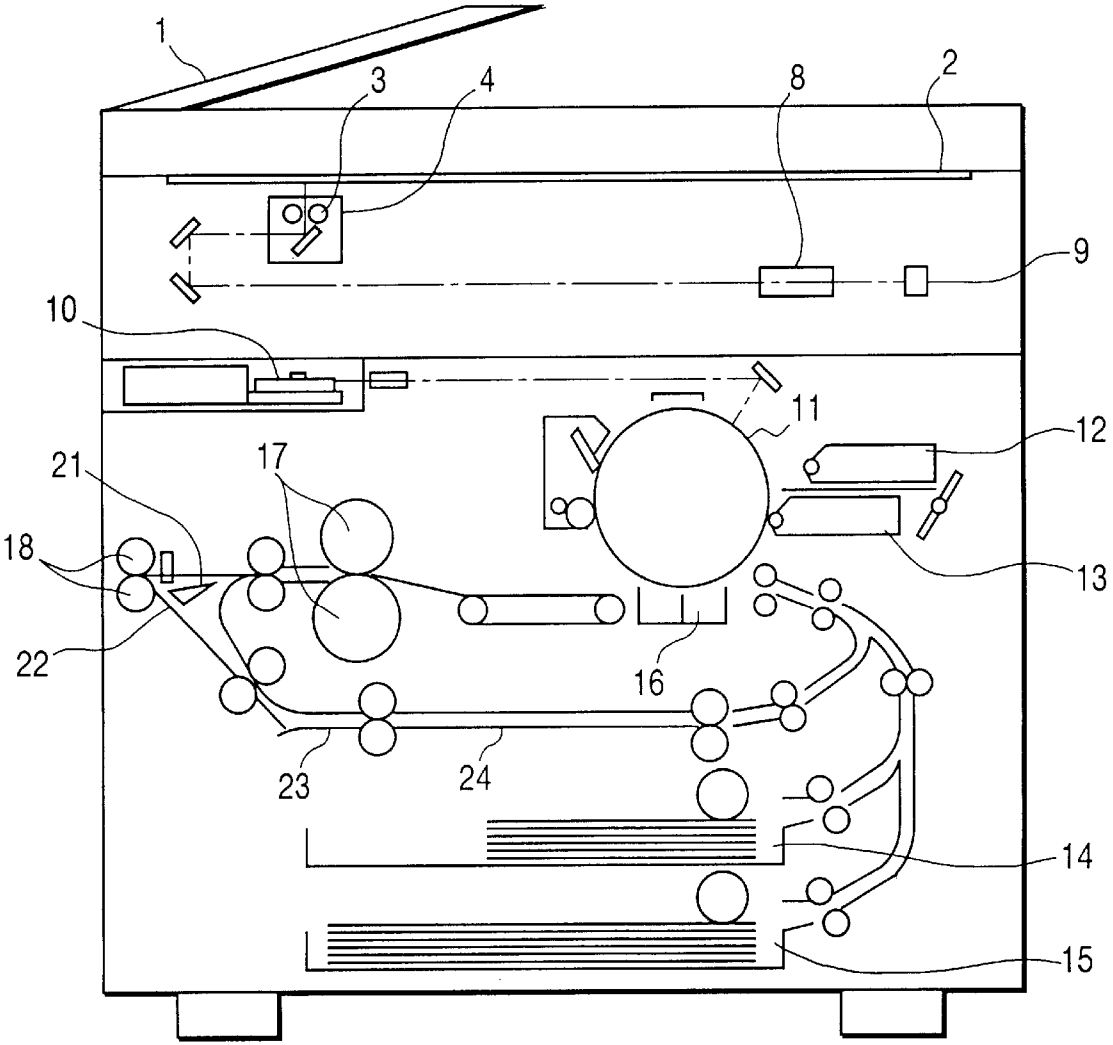
FIG. 2 is a cross sectional view of the image forming apparatus.

FIG. 2 is a schematic cross sectional view showing the structure of an image forming apparatus according to an embodiment of the invention.

Referring to FIG. 2, as a copy start key is depressed, an original placed on an original feeder unit 1 is fed to an original support glass 2. At this time, a lamp of a scanner 3 is turned on and a scanner unit 4 moves to illuminate the original. Light reflected from the original passes via mirrors 5, 6, and 7 to a lens 8 and input to an image sensor unit 9 of the image reading unit 101. The image input to the image sensor unit 9 is processed by the image processing unit 102, and applied to an exposure control unit 10 of the image recording unit 104, or is stored once in the image memory 105 to be processed therein and then again read therefrom and applied to the exposure control unit 10. The image is converted by the exposure control unit 10 into an optical signal which is modulated by an image signal and applied to a photosensitive drum 11. A latent image formed on the photosensitive drum 11 upon application of the modulated signal is developed by a developer 12 or 13. A toner image transferred to a transfer sheet is fixed thereto by a fixing unit 17. The transfer sheet is ejected from a paper ejector 18 in the case of a one side copy and the last copy of a both side copy. In the case of the first copy of the both side copy, the transfer sheet is transported by a flapper to both side transport units 22, 23, and 24.

Figure 3:
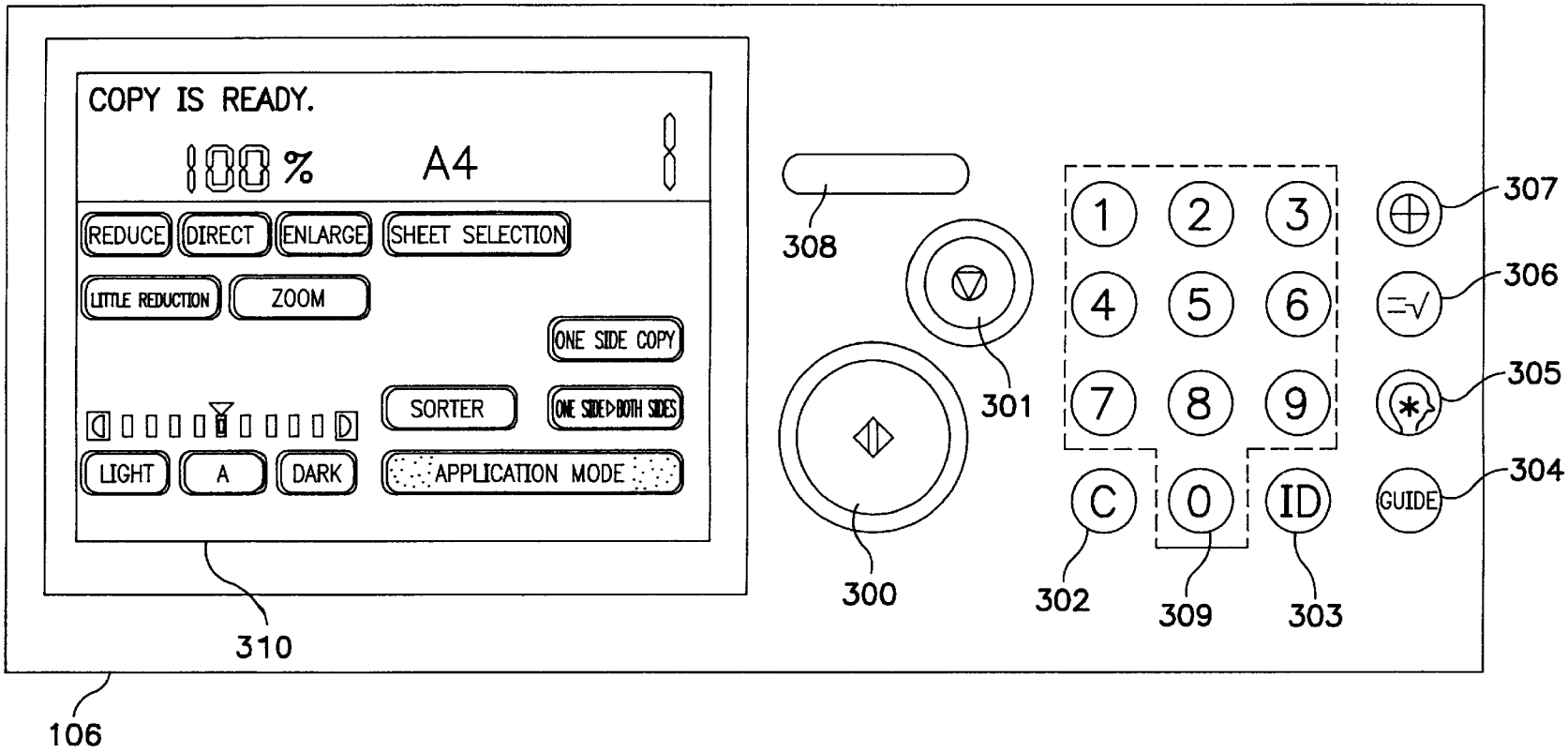
FIG. 3 is a diagram showing an operation/display unit.

FIG. 3 is a diagram showing the operation unit 106. Reference numeral 300 represents a copy start key. Reference numeral 301 represents a stop key which is used for stopping continuous copy. Reference numeral 302 represents a clear key which is used for clearing an entered numeral. Reference numeral 303 represents an ID key, a user being permitted a copy operation if an ID number is entered by using this ID key and a ten key group 3, other users not entering an ID number being inhibited from copying. Reference numeral 304 represents a guide key which is used when a user wants to know a function of each key. Reference numeral 305 represents a user mode key which is used when a specification or state of the apparatus is set up by a user. The user mode includes optional function setting (two types) for setting a soft key to be added on the standard screen of the operation/display unit 106, specification setting, timer setting, and adjustment/cleaning setting. Reference numeral 306 represents an interrupt key which is used during continuous copy to perform another copy. Reference numeral 307 represents a preheat key which is used when the operation mode is moved to a preheat mode or the preheat mode is resumed. Reference numeral 308 represents a reset key which is used when the copy mode is changed to the standard copy mode. Reference numeral 309 represents the ten key group which is used for setting a numeral value, a magnification factor, or the like. Reference numeral 310 represents a liquid crystal display/operation unit which displays the state of the machine and the state of copy mode setting. As an operator touches a displayed soft key, the liquid crystal display screen changes to allow further settings.

Figure 4:
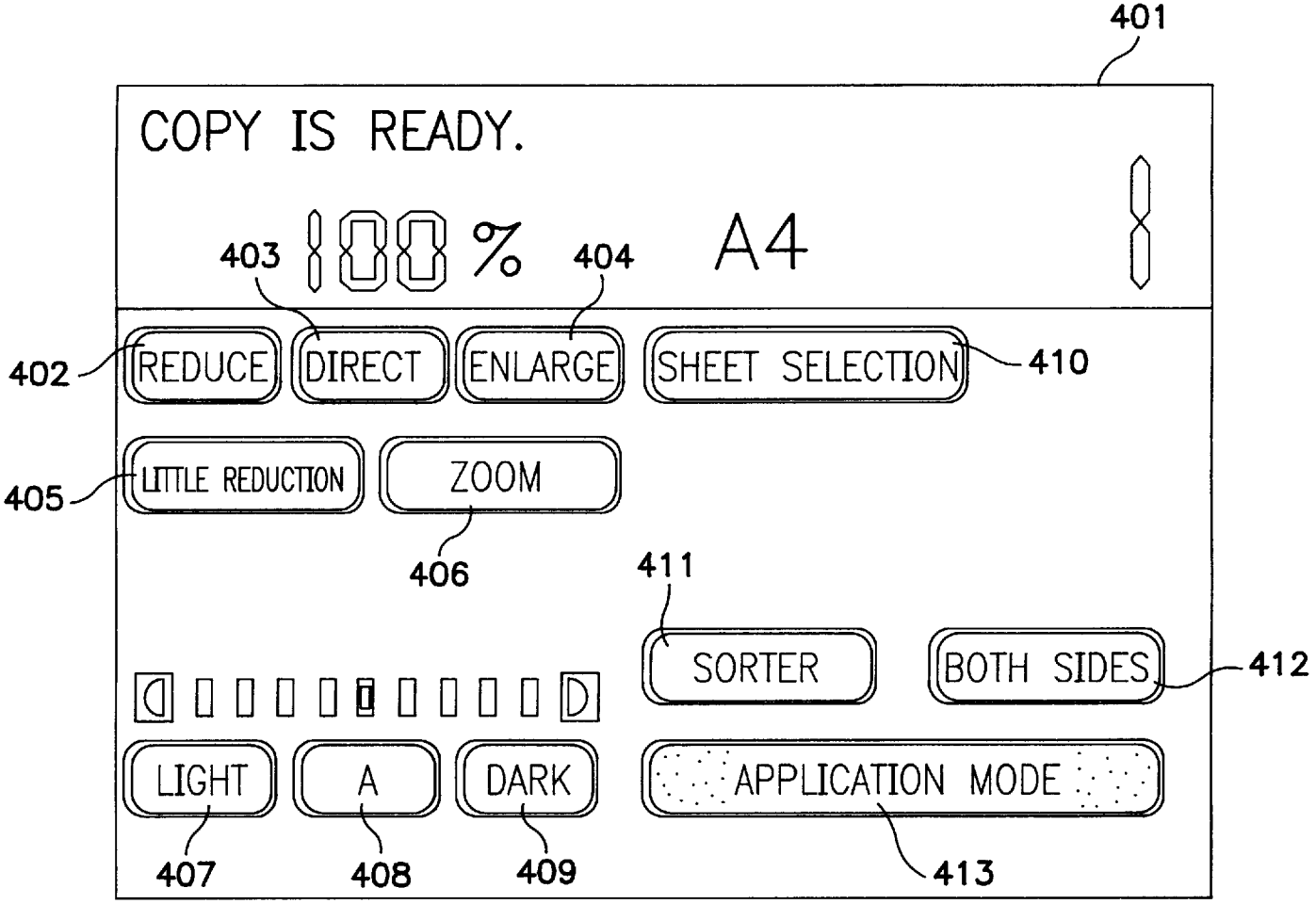
FIG. 4 PRIOR ART
FIG. 4 is a diagram showing a standard screen of a conventional operation unit.

FIG. 4 is a diagram showing a screen of a conventional liquid crystal display/operation unit in a standard state.

Figure 8:
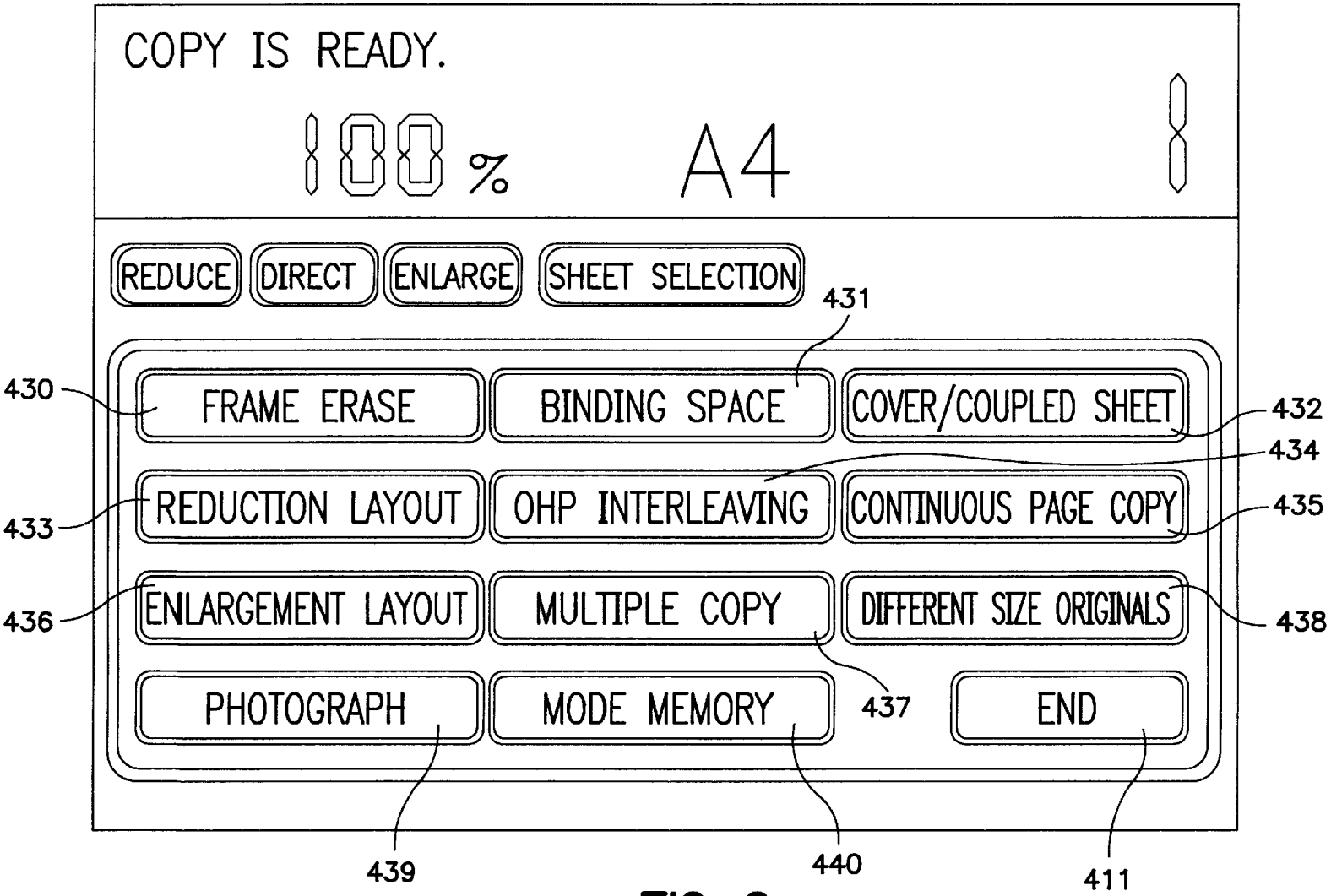
FIG. 8 is a diagram showing an operation screen for selecting the kind of an application mode.

Reference numeral 401 represents a display field for displaying a machine state, a set numerical number, a set magnification factor, a designated paper size, and the like. Reference numeral 402 represents a reduction key which is used for obtaining a reduced copy of a regular size in another regular size. Reference numeral 403 represents an equal size key which is used for copying an image at a magnification of 100%. Reference numeral 404 represents a magnification key which is used for obtaining a magnified copy of a regular size in another regular size. Reference numeral 405 represents a "little small" key which is used for copying an image at a little smaller magnification ratio than the set magnification ratio (the initial magnification ratio for "little small" is 93%, and this initial magnification ratio is changed at the specification setting in the user mode). Reference numeral 406 represents a zoom key which is used for copying an image at an optional magnification ratio, for an auto zoom of automatically calculating a magnification ratio from an original size and a paper size, and for a zoom program function of calculating a magnification ratio by designating image lengths before and after copying. Reference numeral 407 represents a "light" key which is used for obtaining a light copy density. Reference numeral 408 represents an AE key which is used for automatically adjusting a copy density of an original. Reference numeral 409 represents a "dark" key which is used for obtaining a dark copy density. Reference numeral 410 represents a paper selection key which is used for an automatic paper selection (APS) of automatically selecting a paper size in accordance with an original size and a magnification ratio, or for manually designating a paper size. Reference numeral 411 represents a sorter key which is displayed only when a sorter is mounted, and which is used when an output type (non-sort, sort, group sort, staple sort) of recording sheets is set or the position of a staple is set. Reference numeral 412 represents a both side key which is depressed when images are copied on both sides of a recording sheet or a both side original is used. Reference numeral 413 represents an application mode key which displays a screen such as shown in FIG. 8 when it is depressed to use various functions.

Figure 5:
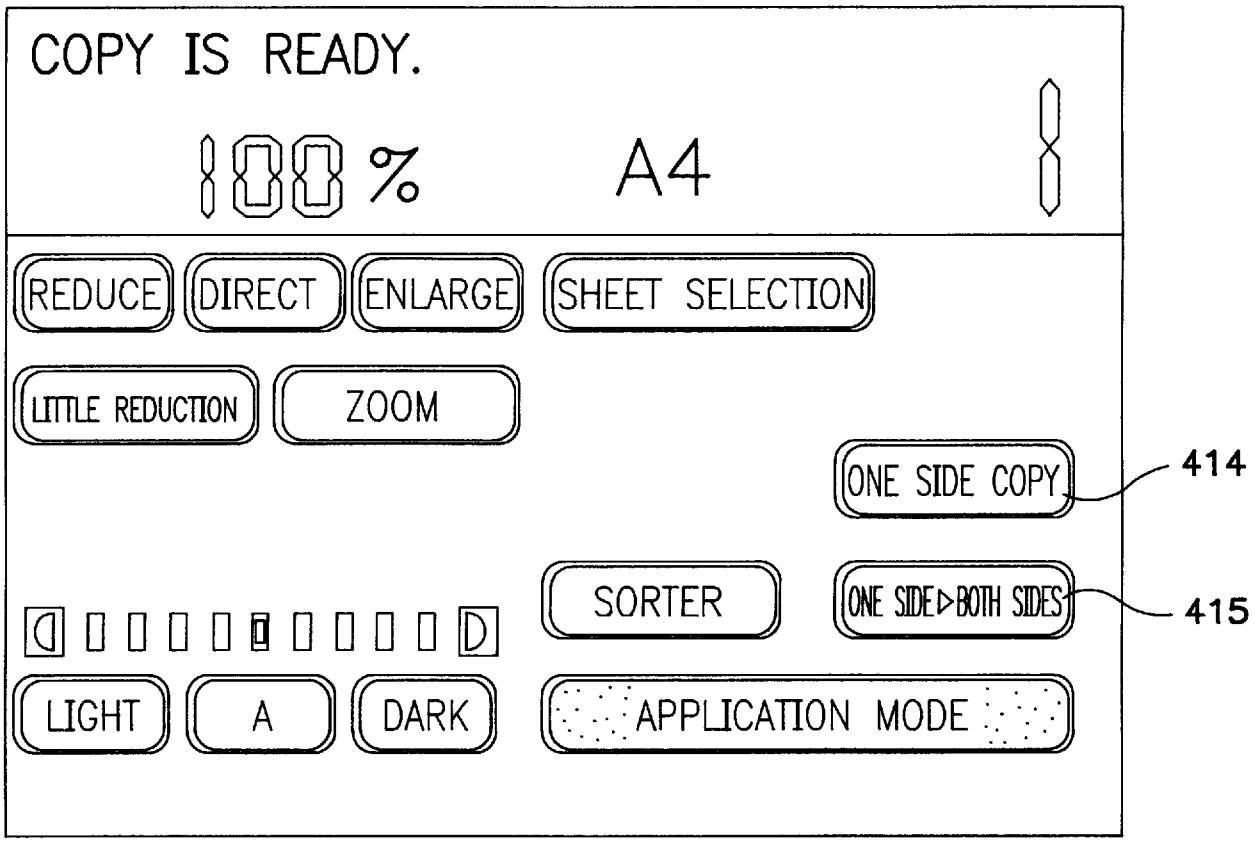
FIG. 5 is a diagram showing a standard screen of a conventional operation unit.

FIG. 5 shows a standard screen of the display/operation unit 310 of this embodiment. This standard screen is displayed when power is turned on, when the reset key 308 is depressed, or when an auto-clear function becomes active because the apparatus is not operated for a predetermined period.

As compared to the conventional display screen shown in FIG. 4, instead of the both side key 412, a "one side→both sides" key 415 is displayed and a one side copy key 414 is additionally displayed. The "one side→both sides" key 415 is depressed when a plurality of one side originals are copied to both sides of recording sheets. The one side copy key 414 is depressed when a one side copy mode is selected in a state where the both side copy mode is being selected. In the standard state (both side copy mode), the "one side→both sides" key 415 is in a depressed state. Therefore, even if the both side copy mode is set as the standard copy mode, the one side copy mode can be selected immediately if only the one side copy key 414 is depressed.

Figure 6:
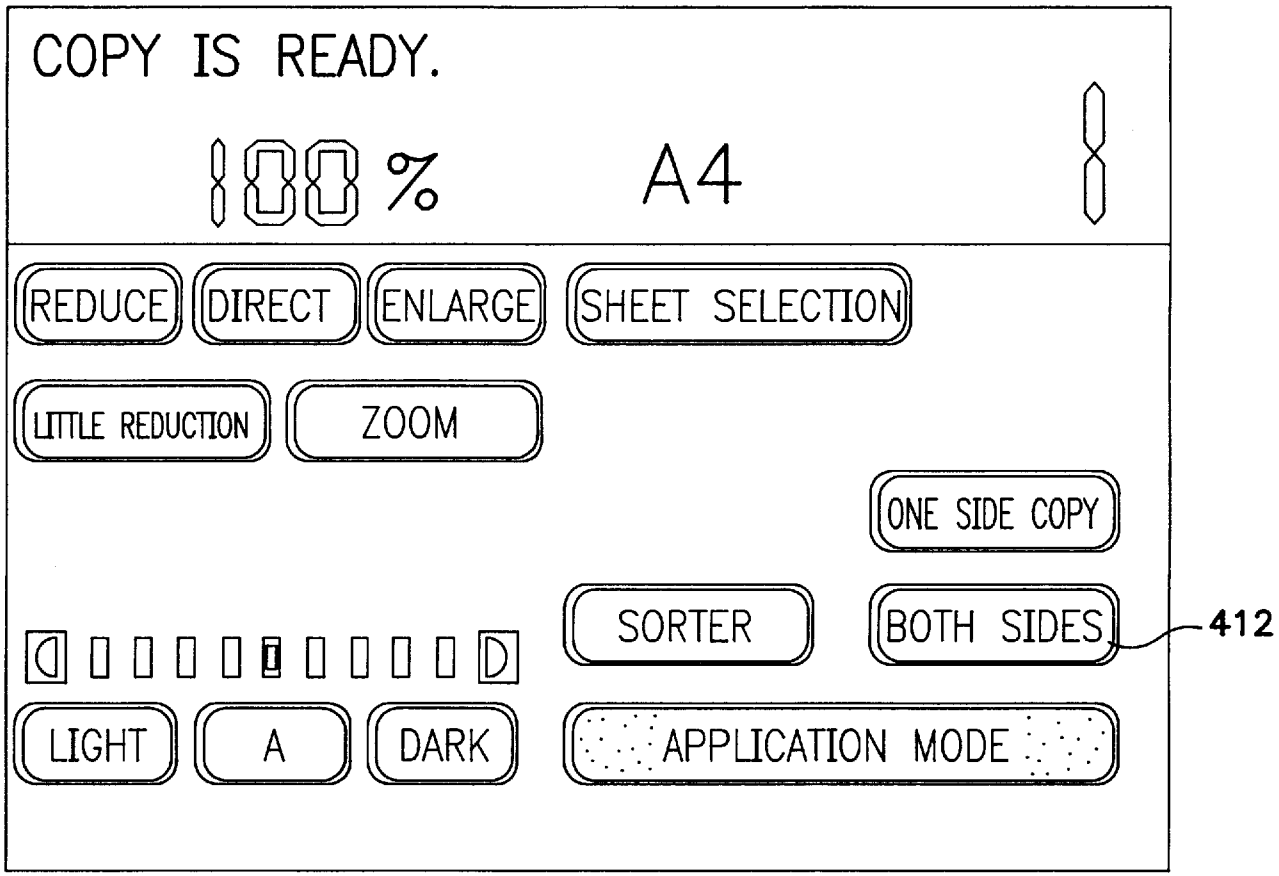
FIG. 6 is a diagram showing an operation screen when a one side copy mode is selected.

As the one side copy mode is selected by depressing the one side copy key 414, the one side copy key 414 is displayed in a black/white reversed state as shown in FIG. 6 and a both side key 412 is displayed in place of the "one side→both sides" key 415.

Figure 7:
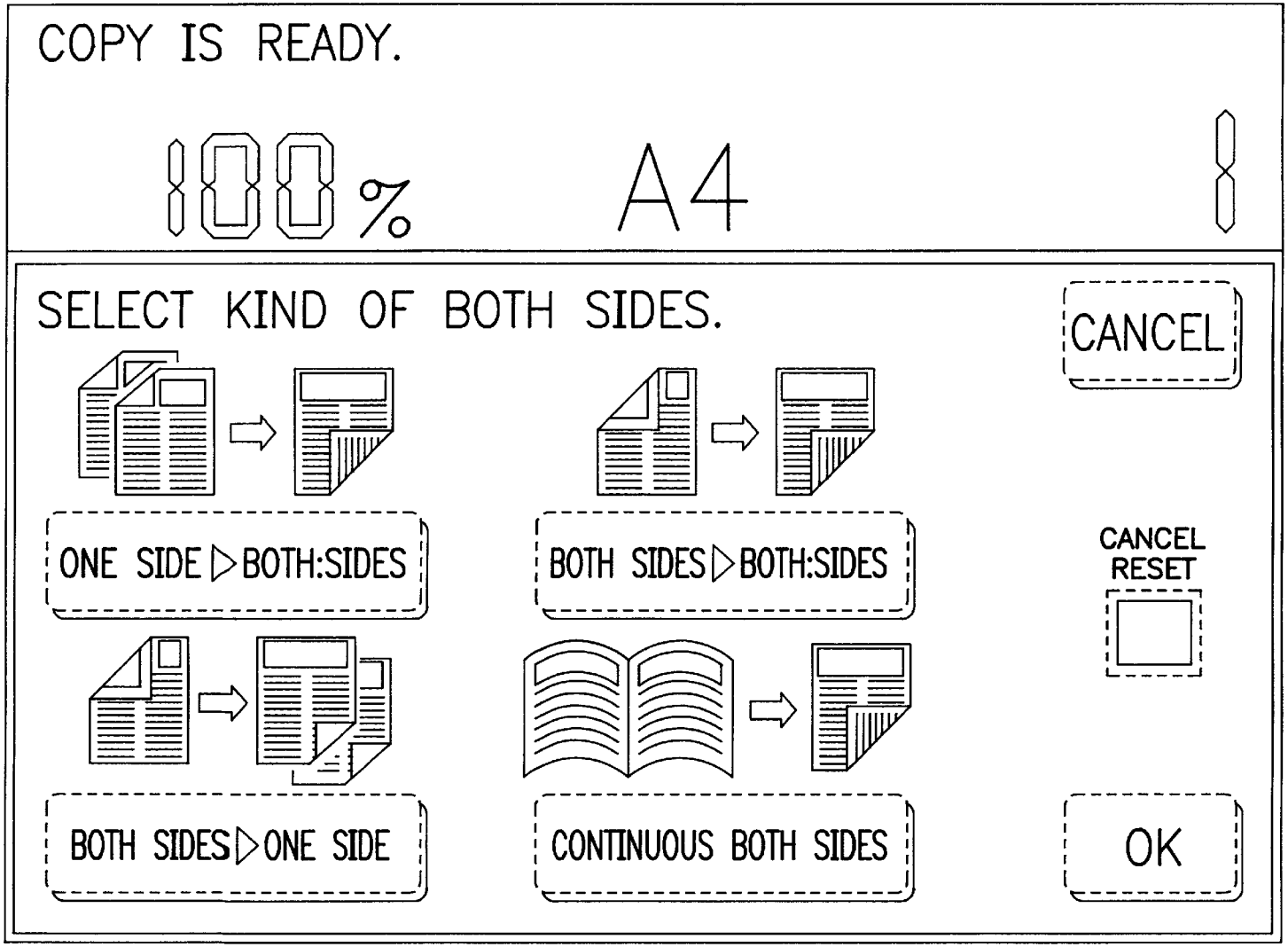
FIG. 7 is a diagram showing an operation screen for selecting the kind of a both side copy mode.

As shown in FIG. 7, when the both side key 412 or the "one side→both sides" key 415 is depressed, a screen is displayed, selected from which is one of a one side→both sides mode for copying images of one side originals to both sides of recording sheets, a both sides→both sides mode for copying images of both side originals to both side of recording sheets, a both sides→one side mode for copying images of both side originals to only one side of recording sheets, and a continuous both side mode for copying images of right and left pages of an opened book to both sides of recording sheets.

FIG. 8 is a display screen obtained, as described earlier, when the application mode key 413 is depressed. Reference numeral 430 represents a frame erase key which is used when a frame is erased in accordance with an operation mode. The operation mode includes a sheet frame erase (forming a blank suitable for a sheet size), an original frame erase (forming a blank suitable for an original size by designating an original size), a book frame erase (forming blanks suitable for a book opened size and a book center by designating a book opened size), and a punching hole erase (forming blanks suitable for punching holes by setting the width of a punching hole, in order not to copy a shade of a punching hole of an original). Reference numeral 431 represents a binding space key which is used for forming a binding space at one end portion of a recording sheet (up, down, right, and left). Reference numeral 432 represents a cover/coupled sheet key which is used when a front cover, a back cover, or coupled sheets are added to copied recording sheets. Reference numeral 433 represents a reduction layout key which is used when a plurality of originals are copied on a single recording sheet in an enlarged or reduced state. This mode includes a "4 in 1" mode for copying four originals to a single recording sheet and a "2 in 1" mode for copying two originals to a single recording sheet. Reference numeral 434 represents an OHP interleaving key which is used for automatically instructing to interleave an OHP sheet and to copy or not to copy an image on the interleaved sheet. Reference numeral 435 represents a continuous page key which is used for dividing a copy area on the original support glass into right and left halves and automatically copying two continuous pages (designating a right opened book, a left opened book, an inverted paper eject, or the like). Reference numeral 436 represents an enlargement layout key which is used for a mode of dividing a single original into a plurality of images in an enlarged state, such as copying images of an original copied in the reduction layout mode. Reference numeral 437 represents a multiple copy key which is used when two images are copied on one side of a single recording sheet. This mode includes a multiple mode and a continuous page multiple mode. Reference numeral 438 represents a different size original key which is used when different size originals (A4 and A3, B5 and B4, and other combinations) are used. Reference numeral 439 represents a photograph key which is used when a photograph is copied. Reference numeral 440 represents a mode memory key which is used when a user set copy mode is stored or when a stored copy mode is called. Reference numeral 441 represents an end key which is used when the application mode screen is terminated. As this key is depressed, the display screen shown in FIG. 5 or 6 appears.

Whether the both side copy mode is set as the standard copy mode for saving natural resources is determined by a service man in a maintenance mode. A service man sets the image forming apparatus to the maintenance mode to select the one side copy mode or both side copy mode (resource saving mode) as the standard copy mode and register it by using respective keys of the operation unit 106.

Instead of registering the both side copy mode as the standard copy mode, a mode of copying a plurality of original images to a single sheet, such as "4 in 1" mode and "2 in 1" mode, may be set as the standard copy mode. In this case, in place of the "one side copy" key, a "1 in 1" key is displayed and in place of the "one side→both sides" key, a "2 in 1" key is displayed.

In the image forming apparatus of this embodiment, a desired image forming mode set by a user in the user mode can be registered as the standard copy mode. However, if a service man has registered the both side copy mode as the standard copy mode, an image forming mode not containing the both side copy mode cannot be registered by a general user.

Figure 9:
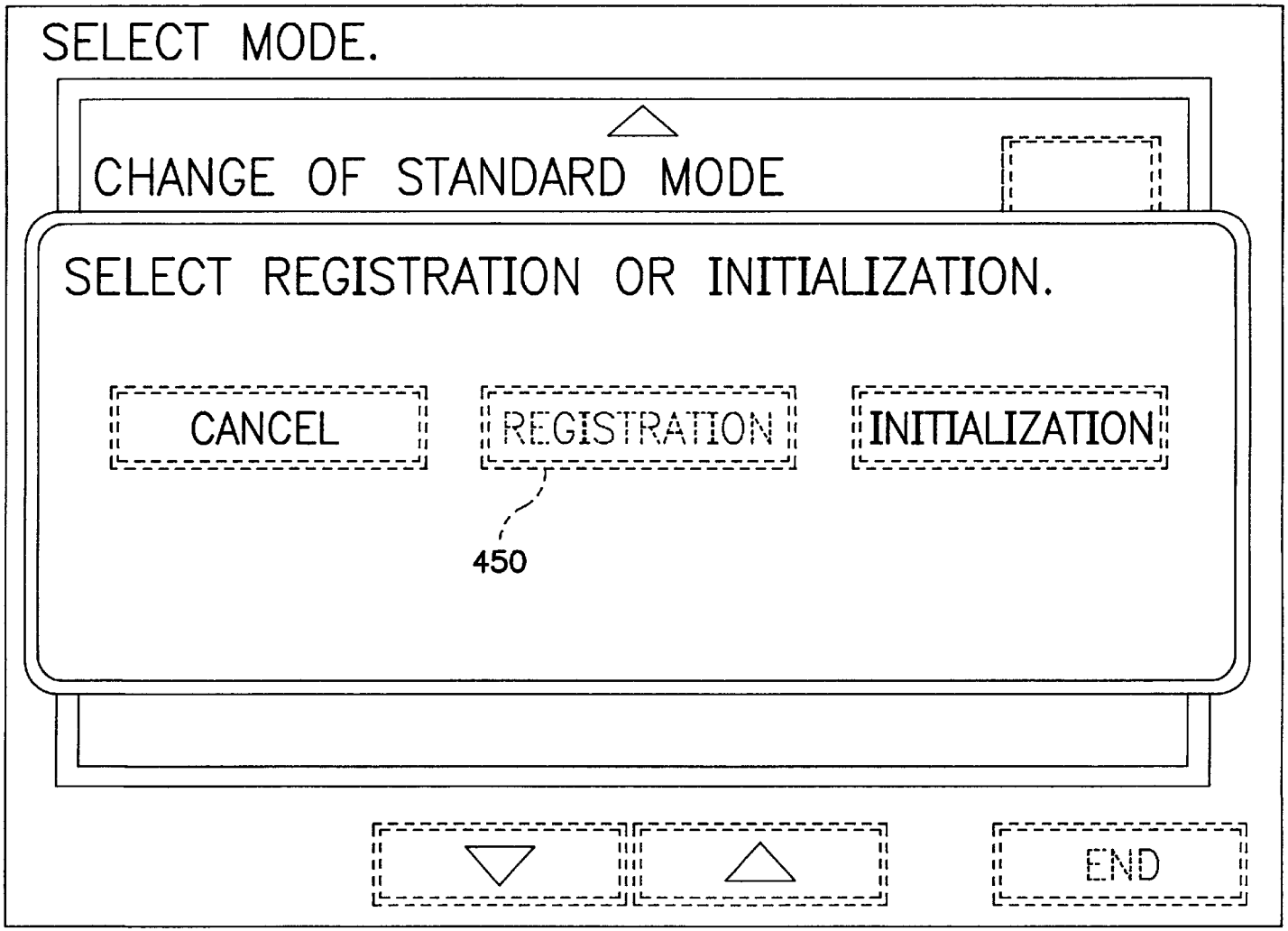
FIG. 9 is a diagram showing an operation screen for changing a standard copy mode.

Specifically, in order to change the standard copy mode, after a desired image forming mode is set, a standard mode change item is selected at the specification setting of the user mode. Then, the CPU control unit 107 checks whether a service man has registered the both side copy mode as the standard copy mode and whether the image forming mode set by a user contains the both side copy mode. If the both side copy mode (resource saving mode) has been registered by the service man as the standard copy mode and if the image forming mode set by the user contains the both side copy mode, then the registration key 450 is displayed in a meshed form as shown in FIG. 9 in order to disable this key and inhibit the registration by the user.

Figure 10:
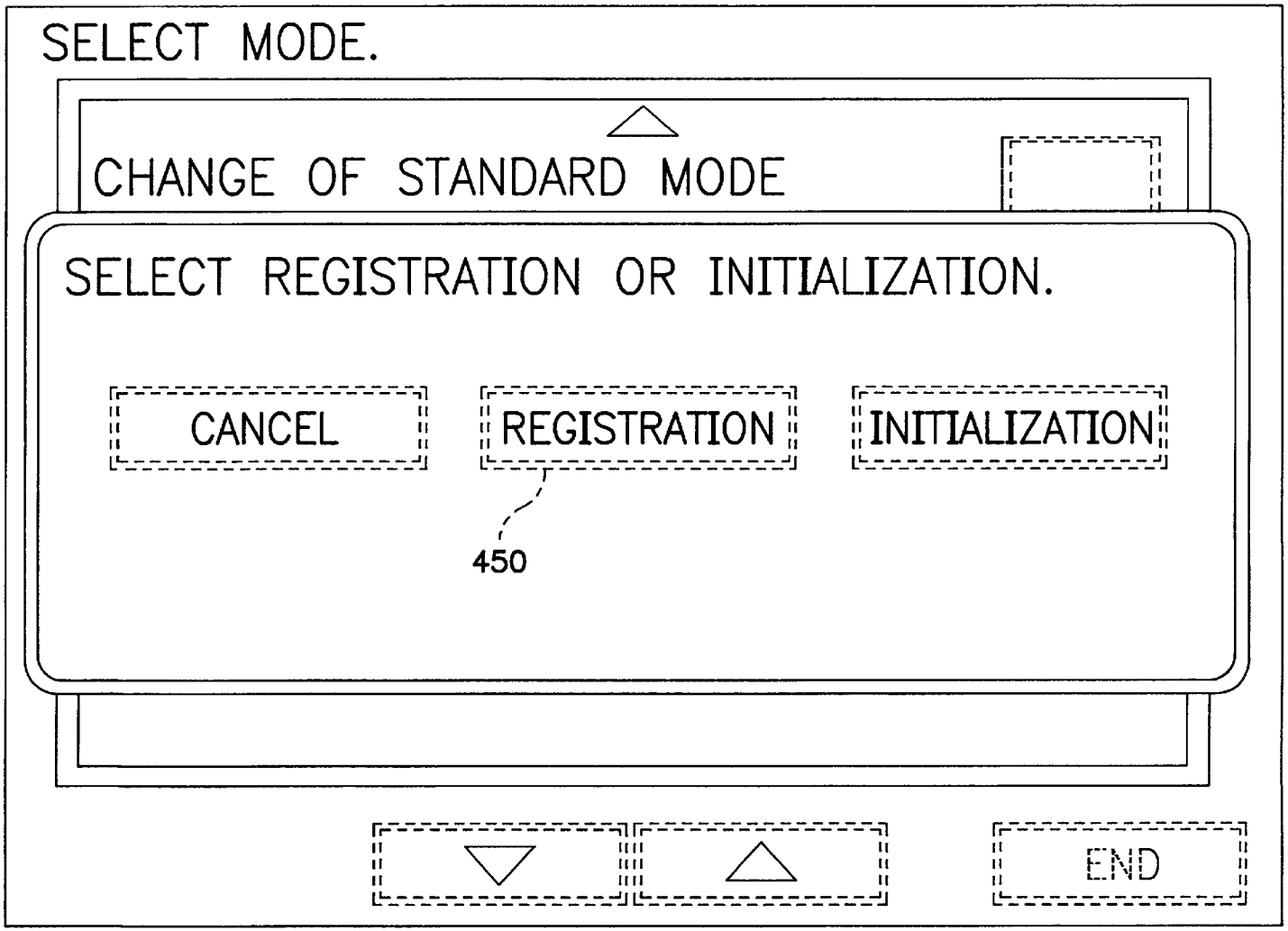
FIG. 10 is a diagram showing another operation screen for changing a standard copy mode.

If the both side copy mode (resource saving mode) has not been registered by a service man, the registration key 450 is displayed as shown in FIG. 10 to allow any image forming mode to be registered as the standard copy mode. The above mentioned reduction layout mode (4 in 1, 2 in 1) may be used as the resource saving mode.

In the image forming apparatus of this embodiment, a maximum of two soft keys of copy modes a user often uses can be set in the standard display screen by using the optional mode setting function in the user mode. If a service man has set the resource saving mode, only one soft key can be displayed because the one side key 414 is already displayed.

Figure 11:
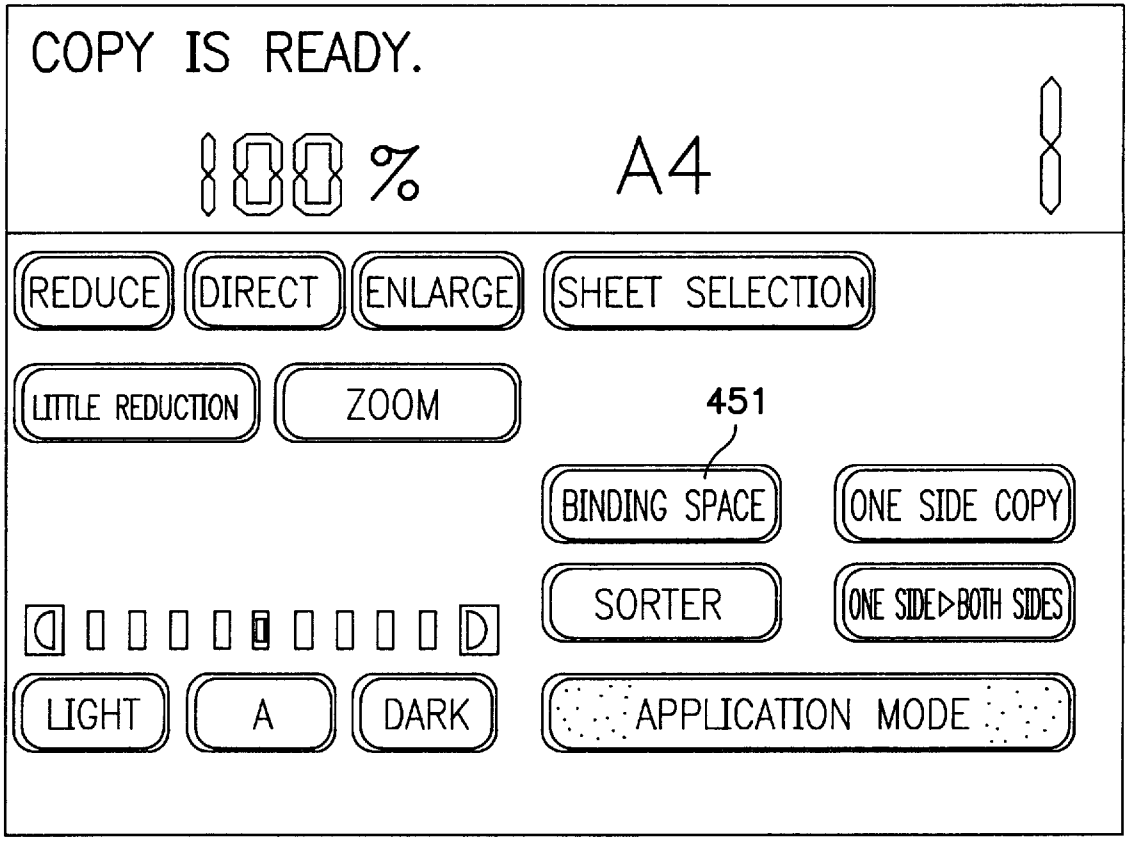
FIG. 11 is a diagram showing a standard screen of the operation unit.
Figure 12:
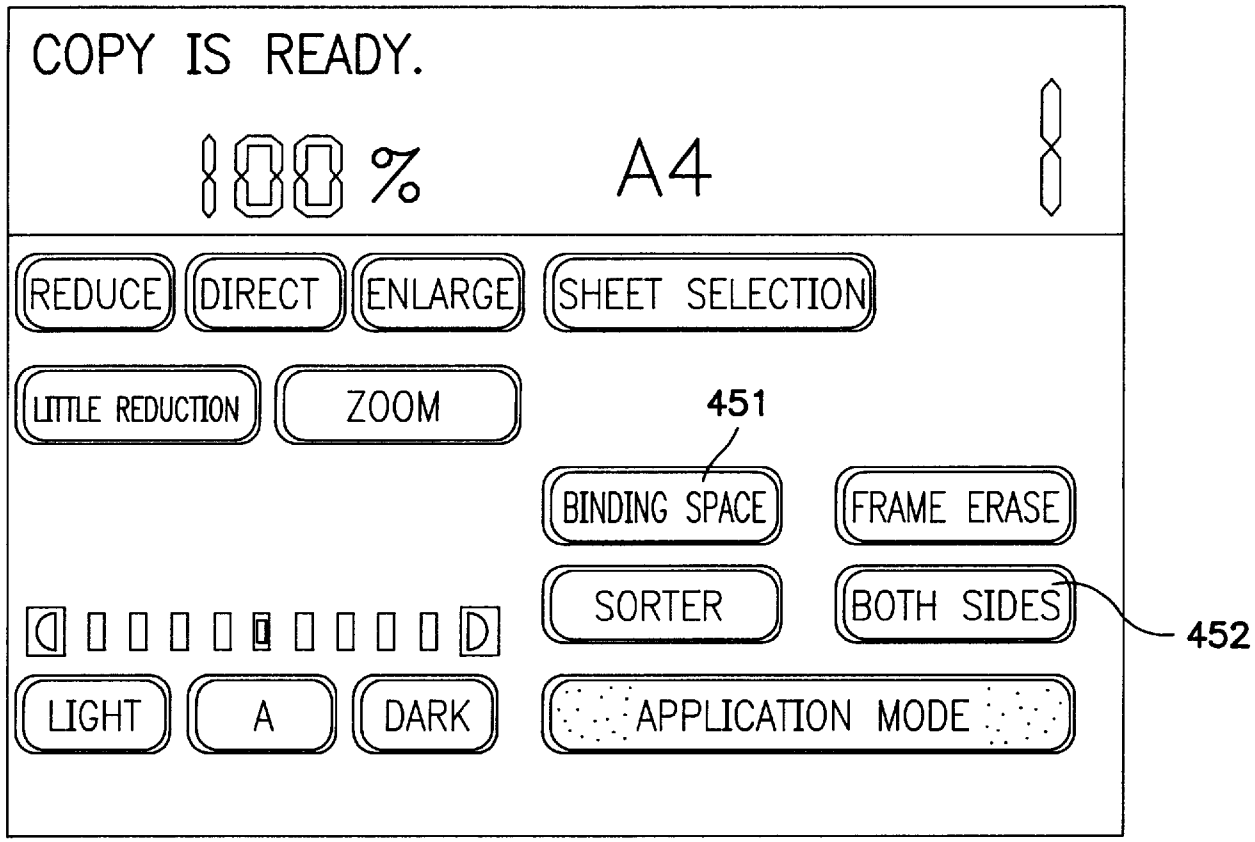
FIG. 12 is a diagram showing another standard screen of the operation unit.

If the resource saving key is already set, one optional key, for example, the binding space key 451 can be displayed as shown in FIG. 11. If the resource saving key is not set, two optional keys 1 and 2, for example, the binding space key 451 and the frame erase key 452 can be displayed as shown in FIG. 12.

Figure 13:
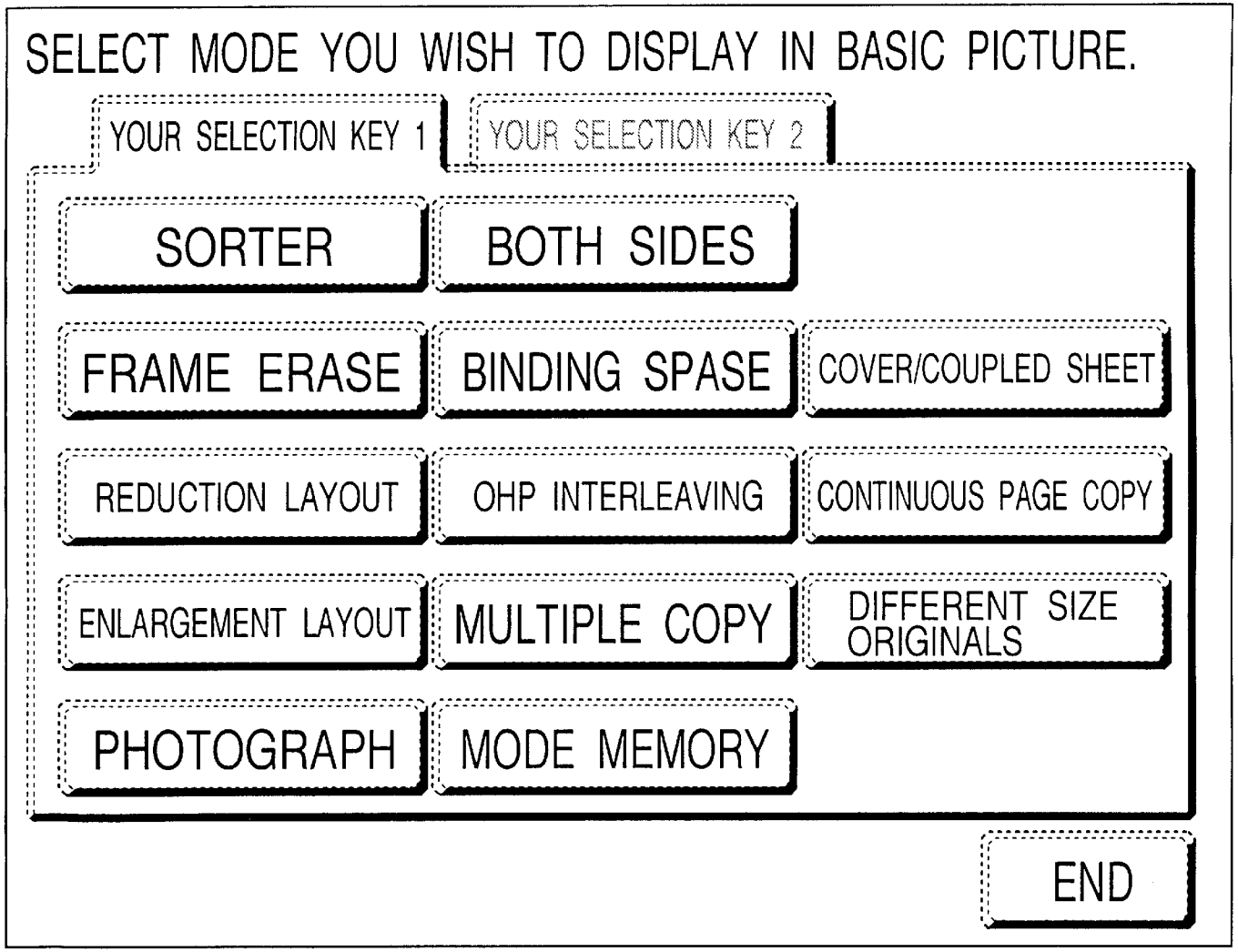
FIG. 13 is a diagram showing an operation screen for selecting a desired type of a key.

If the optional mode setting function is selected, the CPU control unit 107 checks whether a service man has selected the resource saving mode. If selected, a screen for selecting an optional key is displayed as shown in FIG. 13, and the optional key 2 is displayed in a meshed form to allow only the optional key 1 to be selected.

Figure 14:
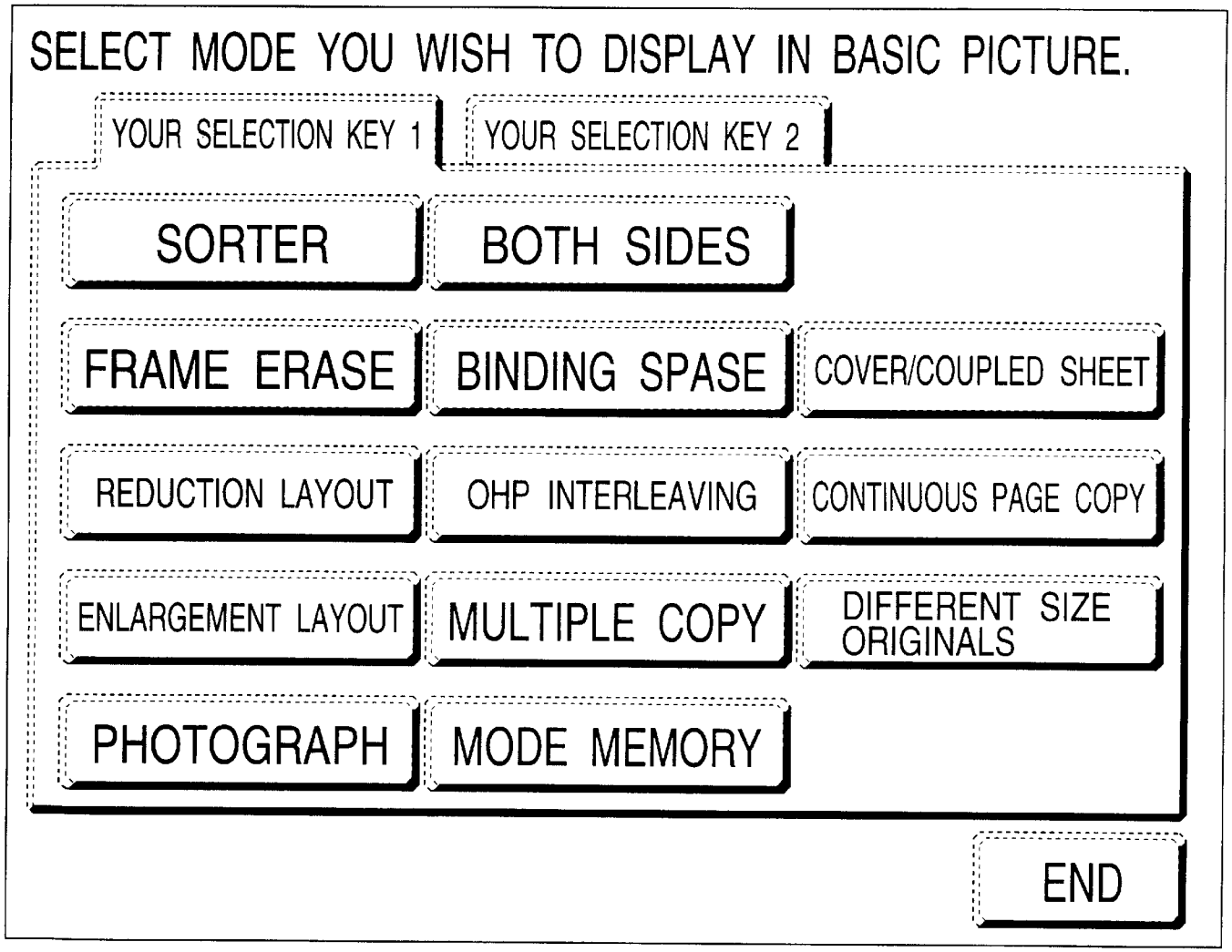
FIG. 14 is a diagram showing another operation screen for selecting a desired type of a key.

On the other hand, if the resource saving mode is not selected, a screen for selecting an optional key is displayed as shown in FIG. 14, to allow a user to select both the optional keys 1 and 2.

In the above embodiment, if the resource saving mode is not selected, the one side key is not displayed. Instead, even if the resource saving mode is not selected, the one side key may be displayed if the both side copy mode is registered as the standard copy mode by changing the standard copy mode in the user mode.

Further, even if the resource saving mode is not selected, the one side key may be displayed in order to immediately resume the one side copy mode when the both side copy mode is set as the image forming mode.

The number of soft keys to be displayed as the optional key is not necessarily limited to a maximum of two if there is a sufficient display area.

As described so far, as the both side copy mode is registered as the standard copy mode, a soft key for selecting the one side copy mode is displayed. Therefore, the one side copy mode can be immediately selected and the apparatus is made easy to use.

If the copy mode set by a user for changing the standard copy mode does not contain the both side copy mode, this copy mode is inhibited from being registered as the standard copy mode. It is possible to prevent the both side copy mode from being inadvertently excluded from the standard copy mode and prevent the effects of saving resources from being halved.

The invention is not limited to the above embodiment, and various modifications are possible without departing from the scope of the claims.

What is claimed is:

1. An image forming apparatus having a one side mode for forming an image on one side of a recording sheet and a both side mode for forming an image on both sides of a recording sheet, comprising:

standard mode registering means for registering the both side mode as one of standard modes of the image forming apparatus;

a plurality of soft keys whose functions change in response to an operation by an operator; and setting means for setting one of the soft keys as a one side mode key used for selecting the one side mode, if the both side mode is registered as one of the standard modes by said standard mode registering means.

2. An image forming apparatus according to claim 1, wherein if the both side mode has not been registered as one of the standard modes by said standard mode registering means, said setting means inhibits setting the soft keys as the one side mode key.

3. An image forming apparatus according to claim 1, wherein said standard mode registering means is operated in a maintenance mode in which a service man performs maintenance of the image forming apparatus.

4. A control method for an image forming apparatus being operable in a one side mode for forming an image on one side of a recording sheet and a both side mode for forming an image on both sides of a recording sheet, and having a plurality of soft keys whose functions change in response to an operation by an operator, comprising the steps of:

a) registering the both side mode as one of standard modes of the image forming apparatus; and b) setting one of the soft keys as a one side mode key used for selecting the one side mode, if said both side mode is registered as one of the standard modes at step a).

5. A control method according to claim 4, wherein at step b) the soft keys are inhibited from being registered as the one side mode key if the both side mode is not registered as one of the standard keys.

6. A control method according to claim 4, wherein step a) is executable in a maintenance mode in which a service man performs maintenance of the image forming apparatus.

7. An image forming apparatus having a first mode for forming one original image on a recording sheet and a second mode for forming a plurality of original images on a recording sheet, comprising:

standard mode registering means for registering the second mode as one of standard modes of the image forming apparatus;

a plurality of soft keys whose functions change in response to an operation by an operator; and setting means for setting one of the soft keys as a first mode key used for selecting the first mode, if the second mode is registered as one of the standard modes by said standard mode registering means.

8. An image forming apparatus according to claim 7, wherein if the second mode has not been registered as one of the standard modes by said standard mode registering means, said setting means inhibits setting the soft keys as the first mode key.

9. An image forming apparatus according to claim 7, wherein said standard mode registering means is operated in a maintenance mode in which a service man performs maintenance of the image forming apparatus.

10. A control method for an image forming apparatus being operable in a first mode for forming one original image on a recording sheet and a second mode for forming a plurality of original images on a recording sheet, and having a plurality of soft keys whose functions change in response to an operation by an operator, comprising the steps of:

a) registering the second mode as one of standard modes of the image forming apparatus; and b) setting one of the soft keys as a first mode key used for selecting the first mode, if the second mode is registered as one of the standard modes at step a).

11. A control method according to claim 10, wherein at step b) the soft keys are inhibited from being registered as the first mode key if the second mode is not registered as one of the standard keys.

12. A control method according to claim 10, wherein step a) is executable in a maintenance mode in which a service man performs maintenance of the image forming apparatus.

13. An image forming apparatus comprising:

key input means for setting a desired image forming mode; and registering means for registering an image forming mode set by said key input means as a standard mode of the image forming apparatus, wherein if the image forming mode set by said key input means does not contain a specific image forming mode, said registering means inhibits to register the set image forming mode as the standard mode.

14. An image forming apparatus according to claim 13, further comprising means for initializing the standard mode registered by said registering means, a standard mode after initialization including the specific image forming mode.

15. An image forming apparatus according to claim 13, wherein said specific image forming mode is a mode of forming an image on both sides of a recording sheet.

16. An image forming apparatus according to claim 13, wherein said specific image forming mode is a mode of forming a plurality of original images on a recording sheet.

17. A control method for an image forming apparatus, comprising the steps of:

a) setting a desired image forming mode;

b) judging whether the image forming mode set at step a) contains a specific image forming mode: and c) registering the image forming mode set at step a) as a standard mode of the image forming apparatus if step b) judges that the specific image forming mode is contained, and if not, inhibiting to register the image forming mode set at step a) as the standard mode.

18. A control method according to claim 17, further comprising the step of:

d) initializing the standard mode registered at step c), a standard mode after initialization containing the specific image forming mode.

19. A control method according to claim 17, wherein said specific image forming mode is a mode of forming an image on both sides of a recording sheet.

20. A control method according to claim 17, wherein said specific image forming mode is a mode of forming a plurality of original images on a recording sheet.

21. An image forming apparatus comprising:

both side mode setting means for setting a both side mode of forming an image on both sides of a recording sheet;

soft keys whose functions change with an operation by an operator; and one side mode setting means for setting one of said soft keys as a one side key for selecting a one side mode of forming an image on one side of a recording sheet, if the both side mode is set by said both side mode setting means.

22. A control method for an image forming apparatus being operable in a one side mode for forming an image on one side of a recording sheet and a both side mode for forming an image on both sides of a recording sheet, and having a plurality of soft keys whose functions change in response to an operation by an operator, comprising the steps of:

(a) discriminating whether said both side mode is set or not;

(b) setting one of said soft keys as a one side key for selecting said one side mode when it is discriminated in said step (a) that said both side mode is set.

23. An image forming method comprising:

a both side mode setting step of setting a both side mode of forming an image on both sides of a recording sheet;

a soft keys step of setting soft keys whose functions change with an operation by an operator; and a one side mode setting step of setting one of said soft keys as a one side key for selecting a one side mode of forming an image on one side of a recording sheet, if the both side mode is set by said both side mode setting step.

* * * * *

UNITED STATES PATENT AND TRADEMARK OFFICE

CERTIFICATE OF CORRECTION

PATENT NO. : 5,832,337

DATED : November 3, 1998

INVENTOR(S) : KEIZO ISEMURA

It is certified that error appears in the above-identified patent and that said Letters Patent is hereby corrected as shown below:

ON THE COVER PAGE AT [57] ABSTRACT

Line 1, "resisters" should read --registers--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*